United States Patent [19]

Kirkman

[11] Patent Number: 4,804,127

[45] Date of Patent: Feb. 14, 1989

[54] FASTENER DRIVING GUN

[75] Inventor: John W. Kirkman, Greenwood, Ind.

[73] Assignee: Master Machine Corporation, Indianapolis, Ind.

[21] Appl. No.: 98,930

[22] Filed: Sep. 21, 1987

[51] Int. Cl.[4] ..... B25C 1/14

[52] U.S. Cl. ..... 227/10

[58] Field of Search ..... 227/8, 9, 10, 11

[56] References Cited

U.S. PATENT DOCUMENTS

| | | | |
|---|---|---|---|
| 3,066,302 | 12/1962 | DeCaro et al. | 227/10 |
| 3,552,625 | 1/1971 | Udert | 227/10 |
| 3,554,425 | 1/1971 | Oesterle | 227/10 |
| 4,349,141 | 9/1982 | Ollivier et al. | 227/10 |
| 4,493,376 | 1/1985 | Kopf | 227/10 X |
| 4,598,851 | 7/1986 | Kopf | 227/10 X |
| 4,655,380 | 4/1987 | Haytayan | 227/10 X |

*Primary Examiner*—Paul A. Bell

*Attorney, Agent, or Firm*—Woodard, Emhardt, Naughton et al.

[57] ABSTRACT

A fastener driving gun has a firing pin, a breach block, and a cartridge magazine strip guide. A cocking lever is pivotally mounted to the guide and has one end portion facing the firing pin and another end portion facing the breech block. The end portions are on opposite sides of the pivot. One end portion is engageable with the firing pin, and the other end portion is engageable with the breech block. The end portions are so related to the firing pin and the breech block and the pivotal mounting that when the breech block advances in engagement with the cocking lever, the cocking lever retracts the firing pin. A sear release pin is so related to the trigger that positive force to move the pin in a firing or opposite direction is possible by manipulating the trigger. A barrel assembly made of two pieces threaded together includes a longitudinally extending top slot receiving a reset pin that assists in control of barrel position and attitude for various conditions of the gun.

16 Claims, 3 Drawing Sheets

FASTENER DRIVING GUN

BACKGROUND OF THE INVENTION

1. Field of the Invention

This invention relates generally to fastener driving guns, and more particularly to a gun capable of using explosive cartridges mounted in a strip-type magazine.

2. Description of the Prior Art

Fastener driving guns are widely used to drive fasteners such as nails, studs or the like into hard materials such as metals or concrete, usually to serve as anchors for something to be attached to the hard material. An example of such a gun is shown in U.S. Pat. No. 3,066,302, issued to DeCaro et al. on Dec. 4, 1962. The gun disclosed in that patent would handle a single cartridge at a time. More recently, guns have been developed which can handle a band or strip of cartridges. Examples are shown in U.S. Pat. No. 3,552,625 issued to Udert on Jan. 5, 1971, and U.S. Pat. No. 3,554,425 issued to Oesterle on Jan. 12, 1971. Those patents show different arrangements for supporting the back of the cartridge magazine strip.

It has been found that, after firing a cartridge, it is desirable to retract the firing pin slightly, to avoid interference with movement of the cartridge shell, and shell magazine strip through the gun to move the next cartridge into position to be fired. Heretofore, a spring has been used to retract the pin. Some difficulties with this approach are the abuse that the pin retract spring receives during the firing of the gun, some resistance to the action of the firing pin and the pin driving spring due to the opposing force of the retracting spring, the necessity of relying on a spring of relatively low spring force for the retraction function, and the possible impedance of its proper function due to corrosive or fouling effects of the combustion products of the explosive cartridges.

In addition to the firing pin retraction aspect of prior art guns, I have observed that at least some of them return the trigger to the ready position without necessarily returning the sear release mechanism to the ready position. The present invention is directed to elimination of the firing pin return spring and providing a positive return of the sear release linkage along with the trigger.

SUMMARY OF THE INVENTION

Described briefly, according to a typical embodiment of the present invention, a fastener driving gun uses a breech block action, following release of the trigger, to retract the firing pin from the path of the cartridge strip upon release of the trigger. A breech block control pin is linked to the trigger whereby positive release action for the control pin can be achieved by reverse manipulation of the trigger. If necessary.

DESCRIPTION OF THE PREFERRED EMBODIMENT

Figures 1, 5, 6:
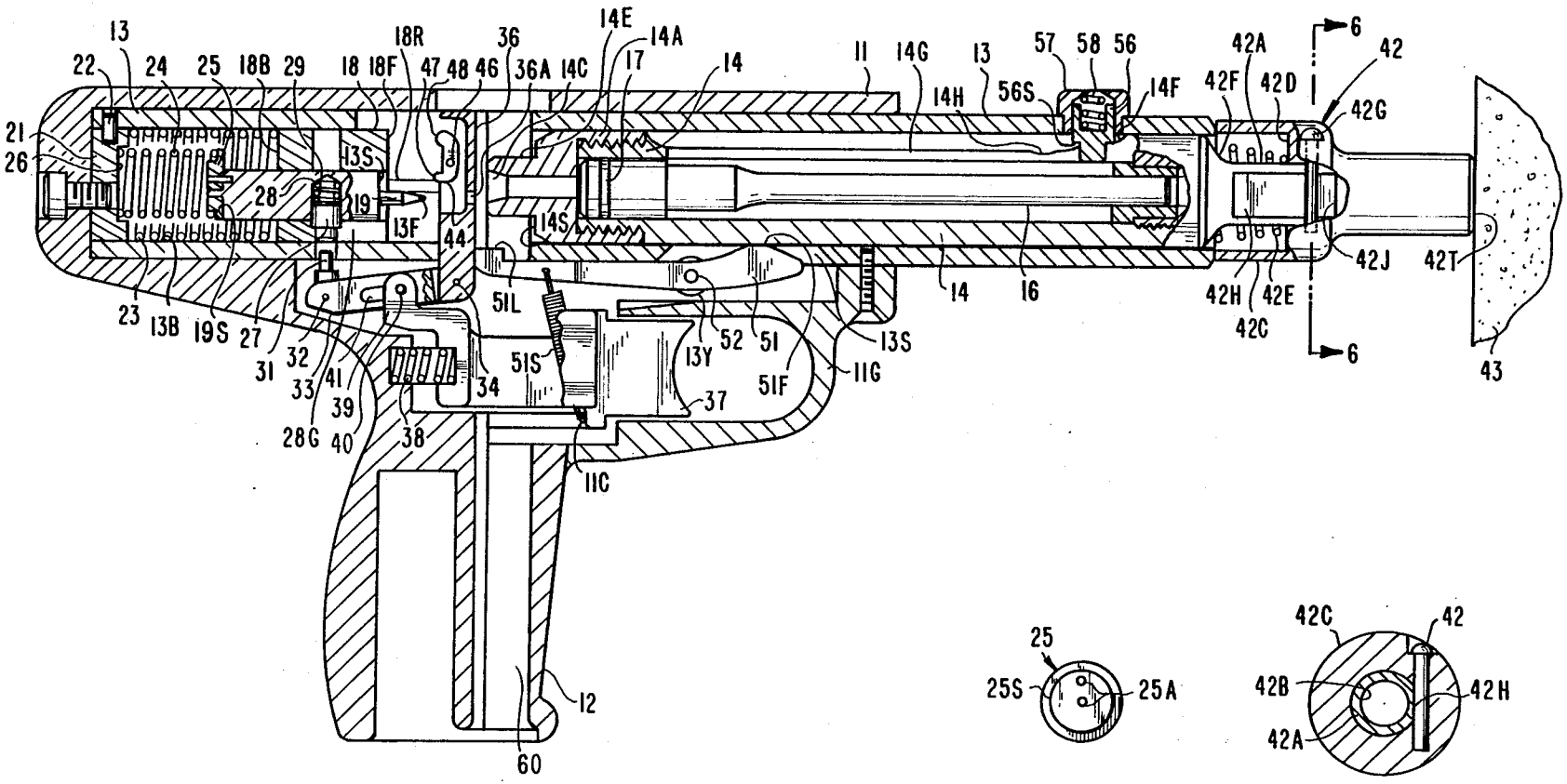
FIG. 1 is a longitudinal sectional view through the gun of the present invention shown in the closed condition, ready to fire.
FIG. 5 is an axial view of a firing pin spring seat washer.
FIG. 6 is a cross section through the safety device taken at line 6—6 in FIG. 1 and viewed in the direction of the arrows.

Referring now to the drawings in detail, and particularly FIG. 1, the gun includes a housing 11 with integral handle 12. A barrel receiver 13 is secured in the housing and receives a two-piece, threaded together barrel assembly 14, 14A longitudinally slidable therein. A fastener driving piston 16 is slidable in the barrel and sealed to the bore of the barrel by a circumferential seal ring 17 of rectangular cross section. A breech block 18 is slidably received in the rear end portion of the receiver 13. Firing pin 19 is slidably received in the breech block. A breech block spring seat 21 is pinned at 22 in the rear of the receiver 13. The breech block spring 23 is compressed between the seat 21 and the rear face 18B of the breech block. The firing pin spring 24 is compressed between a spring seat washer 25 on the firing pin and the end of a pocket 26 in the spring seat 21. Pocket 26 is centered on the centerline of the barrel assembly. The washer 25, although mounted on the firing pin, is offset from the centerline of the firing pin to center the washer on the centerline of the barrel assembly. Thus, the firing pin spring is centered on the centerline of the barrel assembly. The washer 25 is pinned to the rear end 19S of the firing pin by pins 25A (FIG. 5), one projecting to the rear from the centerline of the firing pin and onto which the washer 25 is pressed, and the other being pressed into the washer and firing pin. The firing pin spring is centered on the shoulder 25S (FIG. 5) of the washer 25.

A sear pin 27 having a stepped cylinder configuration has its upper body received in a transverse aperture in the firing pin. The bottom stem 27S (FIG. 2) is received in a forwardly extending slot 28G in the breech block. When the gun is in the ready-to-fire condition of FIG. 1, the lower half of the sear pin body is in a well 28W (FIG. 2) of the breech block and the sear pin is held in the position shown in FIG. 1 by the sear spring 28 received in a cup in the top of the sear pin and seated at the upper end of the transverse blind hole 29 in the firing pin.

A sear release pin 31 has its lower end pivotally connected as by a pin 32 to a sear release lever 33. The forward end of lever 33 is pivotally connected as by pin 34 to the bottom of a cartridge strip block 36 secured in the receiver 13.

A trigger 37 is slidably mounted in the housing and is biased forward by the trigger return spring 38. A trigger yoke 39 is provided at the upper rear end of the trigger, and receives a pin through it and which extends through a slot 41 in the sear release lever. The trigger forward stop condition is reached when the pin 40 receives the forward end of the slot 41 whereupon the sear release pin 31 is retracted entirely from the inner surface bore wall 13B of the receiver 13.

Figure 2:
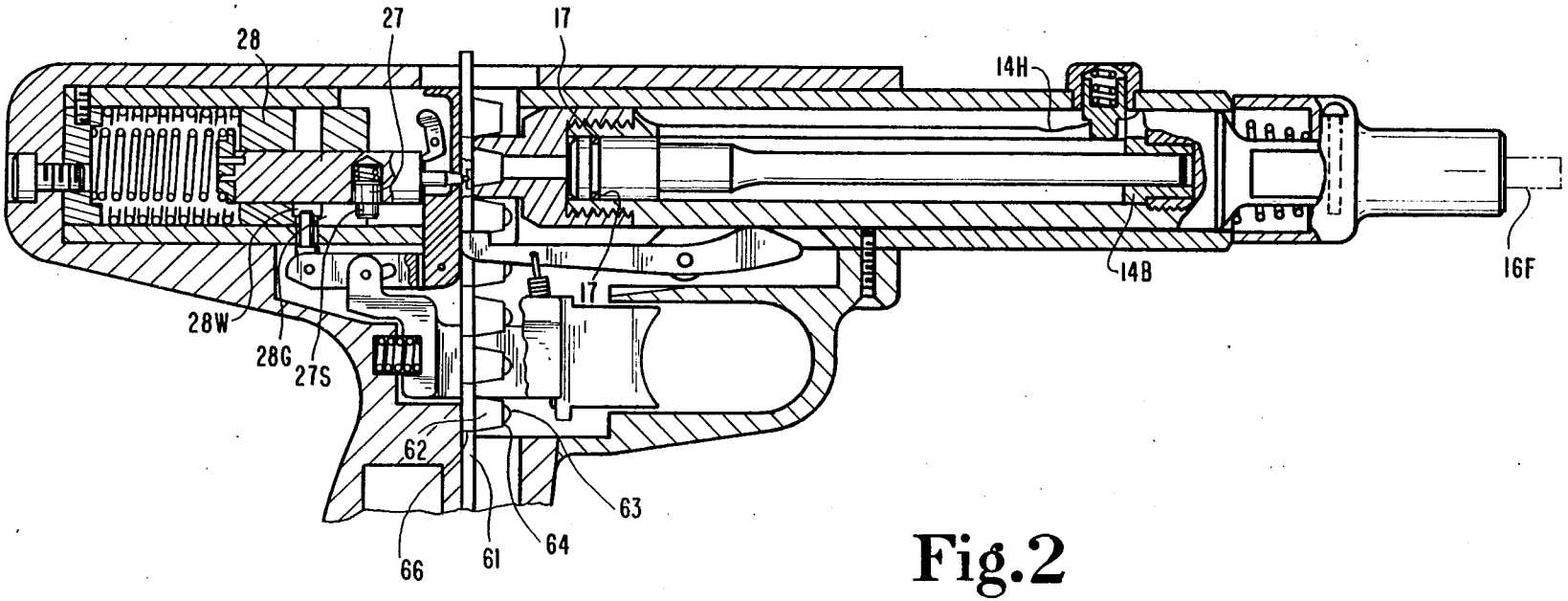
FIG. 2 is a similar view immediately after it has been fired.

A nose assembly 42 includes a muzzle bushing 42A (FIGS. 1, 4, 6) which is screwed into the muzzle end of the barrel 14. The bushing has central bore 42B (FIGS. 4 and 6) typically 0.344 inches in diameter, in which a nail or other fastener may be received for driving. It is also aligned with, and receives through it when the tool is fired, the piston rod 16 as shown in FIG. 2. A safety head 42C is slidably received on the distal end portion of the muzzle bushing. It has a spring seat wall 42D (FIG. 1). A safety device preload compression spring 42E has one end which seats on wall 42D. Its opposite end seats on spring seat flange 42F of the muzzle bushing, and urges the head away from the barrel. A transverse stop pin 42G (FIGS. 1 and 6) received in head 42C is received in the flat 42H in the bushing and permits axial movement of the head relative to the bushing under urging of the spring, but the pin stops such movement when the pin engages the wall 42J at the front end of the flat. When that occurs, the front end or nose 42K (FIG. 4) of the muzzle bushing is set back, or recessed about 0.125 inches from the tip 42T of the safety head 42C. It requires a force of one or two pounds against tip 42T, to collapse safety spring enough for the ends 42K and 42T to become flush. At the same time, the gap 42L is closed and precludes an operator from gripping the muzzle bushing and pulling backward on it in an attempt to arm or cock the gun for use as a weapon or to otherwise shoot fasteners when the muzzle is not pushed against a target. The head 42C can be pulled all the way back to where its rear end abuts the front end of the handle, but without arming the gun. Thus, the rearward motion of head 42C is lost so far as any attempt is made to thereby arm the gun.

Two horizontally-spaced gun-cocking push rods 18B (only one shown) are affixed to the breech block 18, and extend forward from it. They are on opposite sides of the centerline of the tool, and are aligned with the barrel shoulder 14S. In the gun condition illustrated in FIG. 1, they have pushed the breech block back to the position where the sear pin is in alignment with the sear release pin 31. This condition is accomplished only when the front end 42K of the muzzle bushing has been pushed against the fastener receiver material 43 which may be a concrete wall, for example, with a force of at least 20 pounds.

A cocking lever 44, according to the present invention, is pivotally mounted by a pin 46 in the strip block 36. A rearward extending lug 47 is at the lower end of this lever and is engageable by the firing pin when the pin moves forward. The rear edge 48 of the upper end of the cocking lever is engageable with the upper front face 18F of the breech block when the breech block moves forward.

A cartridge magazine advancer lever 51 is pivotally mounted at pin 52 in a yoke 13Y projecting from the bottom of receiver 13 at opposite sides of the downwardly opening slot 13S therein. An advancer return spring 51S is connected between the rear portion of the lever 51 and the bottom of the trigger at 11C at the back of the trigger guard 11G, and biases the lever 51 in a counterclockwise direction. The trigger guard serves as a stop to the counterclockwise return motion of the lever. An upwardly facing lug 51L is located at the rear end of this lever and an upwardly facing cam follower surface 51F is located at the front end of this lever and received in the downwardly opening slot 13S of the receiver 13. The pivotal mounting at pin 52, and the orientation of spring 51S are essentially the same as at pin 19, opening 18C and spring 20 in the above-mentioned Oesterle patent to enable movement in the non-advancing direction as described for transport lever 18 in that patent.

A reset pin 56 is vertically slidably received in the bore of a reset cap 57 which is screwed into the top of the receiver 13 near the front end. Reset spring 58 normally urges the reset pin downward. The bottom shoulder 56S of the reset pin rests on the surfaces 14F of the barrel assembly when the latter is in the position shown in FIG. 1. The surfaces 14F are at opposite sides of the longitudinally extending slot 14G in the top of the barrel assembly. A small hole, for escape of combustion products, is provided at the top center of the cap 57.

Figure 3:
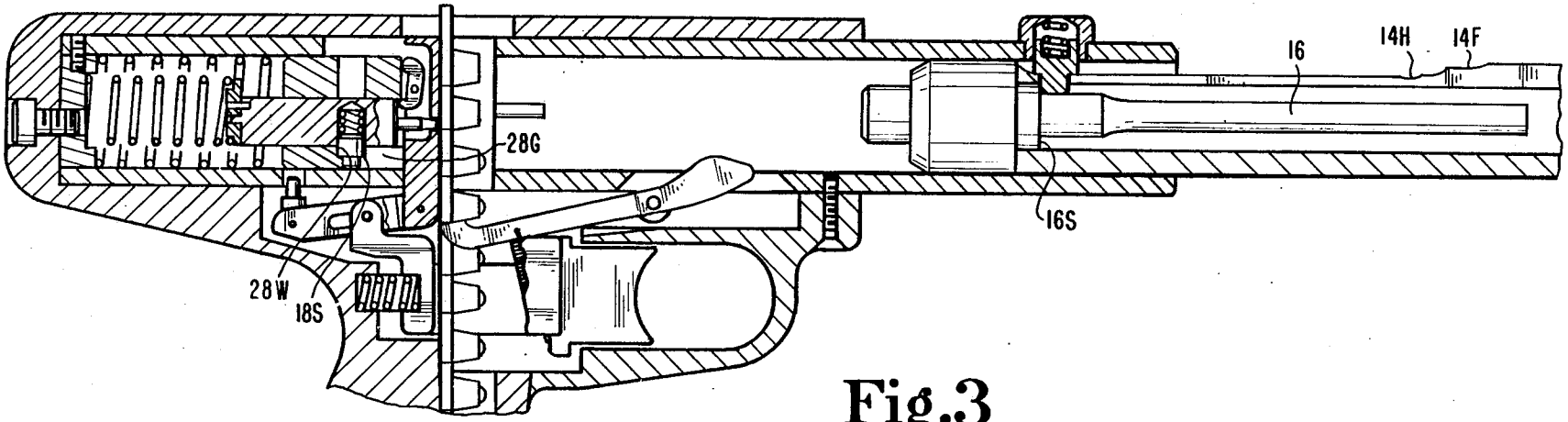
FIG. 3 is a similar view with the gun open after firing, and ready to advance the cartridge magazine strip.
Figure 4:
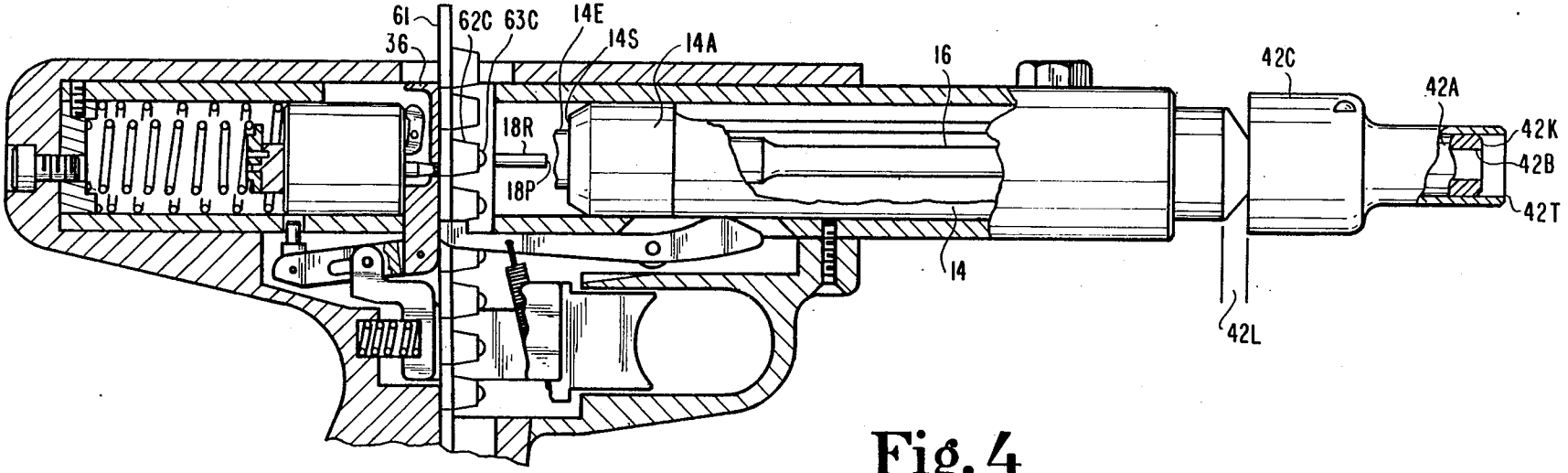
FIG. 4 is a similar view of the gun in the carrying condition, wherein it cannot fire.

A cartridge magazine strip receiving channel 60 is provided in the handle and extends up entirely through it. This is to receive the cartridge magazine strip 62 which is not shown in FIG. 1 to avoid obscuring some of the features to be described, but is shown in FIGS. 2-4. The cartridge receiving chamber 14C is provided in the barrel extension 14E at the rear of the barrel part 14A. A cartridge access aperture 36A is provided in the strip block 36 to receive the cartridge firing end 13F of the firing pin.

Referring now to FIG. 2, the cartridge strip 61 is typically a plastic strip generally of the type shown in the aforementioned Oesterle and Udert patents and is available from the assignee of their patents. It includes a plurality of cartridge cups 62 (typically ten per strip, although only seven are shown in these drawings) which receive cartridges 63 therein, the tips of which are shown extending from the front ends 64 of the cups 62. These cups are linearly spaced along the length of the strip. Notches 66 are provided in the sides (typically eleven on each side) of the strip and receive the lug 51L of the advancer lever. It can be observed that the shape of the cartridge cups is generally conical for compatibility with the cartridge chamber 14C in the rear of the barrel extension 14E of FIG. 1. The cooperation of these features is essentially the same as that shown and described in the aforementioned Udert and Oesterle patents.

Operation

In the use of the fastener driving gun, it is normally in the "carry" condition shown in FIG. 4 where the barrel assembly is forward, the rear end of the barrel extension 14E being broken away in the drawing to show the front end 18P of the breech block push rod 18R. It can be seen that this is spaced behind the flange or shoulder 14S of the barrel. Consequently, with the barrel in the forward position, the breech block spring 23 has driven the breech block forward its maximum distance to where the front face 18F thereof engages the back face of the strip block 36. As it does so, it pivots the cocking lever 44 slightly in the clockwise direction as it pushes against the edge 48 at the upper end of the cocking lever. The lug 47 engaging the front shoulder 13S of the firing pin, pushes it back slightly to the position shown best in FIG. 3 whereupon the sear spring 28 pushes the sear pin body into the pin receiving well 28W (FIGS. 2 and 3) of the breech block. The sear pin stops upon engagement of its shoulder with the shoulder 18S in the breech block. Stem 27S extends down from there into the slot 28G which extends to the front face 18F of the breech block.

With the firing pin thus retracted from the front face of strip block 36, the magazine strip 61 is then easily inserted through the bottom of the handle into channel 60, and pushed upward. Strip detenting is provided. For this purpose, a spring loaded ball (not shown) is located in the housing and positioned to engage in edge notches 66 in the magazine strip. The magazine strip is pushed upward until the ball is received in the uppermost side notch. To move the top cartridge up to alignment with the centerline of the barrel, the gun is opened by pulling the barrel out as in FIG. 3, and then closed to the carry condition of FIG. 4. In the carry condition of the gun, one of the cartridge cups 62 is located as at 62C directly behind the cartridge chamber 14C of the barrel. Although both the firing pin spring and the breech block spring both have some compression on them in this condition, that of the breech block spring is greater which, combined with the relative moment arms of the cocking lever 44 about pin 46 and the lesser force applied by the firing pin spring, assures that the firing pin will remain retracted from the rear end of the cartridge 63C in line with the barrel. Besides, the barrel extension 14E is substantially spaced from the magazine strip 61 so there is no surface against which the strip can be supported to aid in holding the shell in position for striking by the firing pin. Consequently, the gun cannot be fired in this condition.

To prepare to drive a fastener, the fastener to be installed is inserted in the bore 42B of the muzzle bushing 42A. To put the gun in firing condition as shown in FIG. 1, it is necessary to place the front end 42K of the muzzle bushing 42A against the hard surface to receive the fastener. Upon pushing the gun forward, the gap between shoulder 14S and the front ends 18P of the breech block push rods 18R will close, whereupon further pushing of the gun will push the breech block back relative to the receiver. The sear pin maintained in well 28W by spring 28, will carry the firing pin back along with the breech block. Both the breech block spring and firing pin spring are compressed during this step. When the breech block has been pushed back far enough for alignment of the stem 27S of sear pin 27 with the sear release pin 31, the trigger can be pulled. Due to the loading of the breech block spring and firing pin spring, this alignment event cannot occur until at least a 20 pound force is applied to the muzzle bushing end 42K to compress the breech block spring sufficiently for the alignment of the sear pin with the sear release pin to occur.

When the trigger is pulled, the pin 40 moves along the inclined upper edge of the slot 41 in the sear release lever 33 and thereby moves it upward, pivoting the sear release lever in a clockwise direction, whereupon the sear release pin 31 will push upward into the slot 28G in the breech block and push the sear pin upward against its spring 28. As soon as the trigger has been pulled far enough to push the upper body of the sear pin out of well 28W in the breech block, the shoulder 18S of the sear pin becomes flush with the firing pin bore of the breech block, and the firing pin spring will drive the firing pin forward whereupon the tip 13F thereof will pass through the aperture 36A in the strip block 36 and strike the rim of the shell of the cartridge. As the firing pin moves forward, the sear pin stem moves forward in and is guided by the slot 28G. Thus the rotational index of the firing pin in the breech block is maintained.

When the cartridge is thus fired, the pressure from the exploding cartridge drives the piston 16 forward toward the position shown by the dotted line 16F in FIG. 2 which drives the fastener into the surface 43. How far it is driven depends on the nature of the fastener, the receiving material, and the load in the cartridge. It is generally preferable not to drive the piston end beyond the muzzle bushing end. In any case, buffer 14B will inhibit advance beyond the overdrive piston illustrated by the dotted line 16F in FIG. 2. The gas can escape through the slot 14G in the barrel, and then through the aperture in the top of the reset cap 57.

To prepare for the next cartridge, the gun is opened by pulling the barrel out to the condition shown in FIG. 3. This travel is stopped by the reset pin 56 which has advanced radially inward toward the barrel centerline into the position shown in FIG. 3 where the reset pin stem stops the shoulder 16S of the piston and will prevent further outward travel of the piston or the barrel. As the barrel is pulled out, the forward end 51F of the advancer lever is able to move up into the position shown in FIG. 3 under the influence of the advancer spring 51S. The end lug 51L thereof thereupon moves downward into the next edge notch 66 in the magazine strip 61. It is able to move out of one notch and down to the next notch as assisted by the spring 51S and pivot 52 in a manner as described in the Oesterle patent at column 3, lines 23–53, which description is incorporated herein by reference. Then, when the barrel is pushed back to the position shown in FIG. 4, it forces the cam surface 51F of the barrel advancer lever downward, and the lug 51L thereof moves the magazine strip upward to place the next cartridge in axial alignment with the barrel. The shoulder 56S of reset pin 56 drops into the detent notch 14H in the top of the barrel, to hold the barrel in position of FIG. 4 during handling, carrying and while approaching the surface into which the next fastener is to be driven. The seal 17 prevents the piston from falling away from the chamber 14C. The gun is then ready for cocking when the nose assembly is pushed against the fastener receiving surface as described above.

The two-piece barrel construction, with internal threads on part 14A, facilitates machining and heat treatment without distortion. It also facilitates change in power of the gun assembly by simply changing the part 14A wherein the cartridge receiving chamber diameter affects the power derived from a given cartridge size. Also, the two-piece construction facilitates replacement of either part 14 or 14A for replacement if worn, deteriorated or damaged.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. In a fastener driving tool having a housing, a barrel, a fastener driving piston, a cartridge magazine, a firing pin, a firing pin control sear, and sear release means, the improvement comprising: a trigger and linkage in said sear release means and operable upon movement of said trigger in one direction to move the sear in one direction to release the firing pin, said trigger and linkage being operable upon movement of said trigger in a direction opposite said one direction to positively remove said sear release means from said sear.

2. The improvement of claim 1 wherein: said sear release means includes a sear release pin slidably mounted in said housing, said linkage including a lever pivotally mounted to said housing and pinned to said sear release pin, said lever having cam follower means therein engaged with a cam on said trigger.

3. The improvement of claim 2 wherein: said cam follower is a slot in the lever, and said cam is a pin mounted in the trigger.

4. In a fastener driving tool having a housing having a front and rear end, barrel means longitudinally movable forward and rearward in said housing, a fastener driving piston in the barrel means, and a cartridge receiving chamber in the barrel means, the improvement comprising:

an elongate slot in the top of the barrel means; and a reset pin supported by said housing and projecting into said slot and operable to limit movement of said barrel means in said housing;

a cartridge magazine in strip form in said housing;

a breech block in said housing;

a firing pin;

firing pin release sear means;

a lever pivotally mounted in the housing and located in front of at leaat a portion of the breech block and the firing pin and operable, when engaged by the breech block, to push the firing pin rearward from a cartridge firing position, to facilitate movement of said magazine in said housing to advance another cartridge to position at said receiving chamber;

gun cocking rod means on said one of said breech block and said barrel means and engageable with the other of said breech block and said barrel means when said barrel means is moved rearward to enable the sear means to release the firing pin; and a cartrige magazine advancing lever pivotally mounted in the housing and pivotable by said barrel means while said barrel means is moved rearward, said lever being operable on said magazine when pivoted by said barrel means to advance another cartridge to position at said receiving chamber.

5. In a fastener driving tool having a housing, barrel, fastener driving piston in the barrel, breech block, firing pin, and cartridge magazine in strip form, the improvement comprising:

a firing pin retracting means for retracting the firing pin from the path of travel of the cartridge strip through the tool, said retracting means including a lever pivotally mounted in the housing and located in front of at least a portion of the breech block and the firing pin and operable, when engaged by the breech block, to push the firing pin rearward from a cartridge firing position.

6. The improvement of claim 5 and wherein:

said breech block is generally cylindrical about a longitudinal axis in the tool and receives said firing pin therein, said firing pin being elongate and having its longitudinal axis offset from and parallel to the longitudinal axis of the breech block.

7. In a fastener driving gun having a housing, a barrel in the front of the housing, a cartridge guide, a breech block in the rear of the housing, and a firing pin, said firing pin and breech block being movable forward and rearward in said housing, the improvement comprising:

a cocking lever having a pivotal mounting to said housing and having one end portion facing said firing pin and another end portion facing said breech block, said end portions being on opposite sides of the pivotal mounting to said housing, said one end portion being engageable with said firing pin, and said another end portion being engageable with said breech block, said end portions being so related to said firing pin and said breech block and said pivotal mounting that, when said breech block moves forward in engagement with said cocking lever, said cocking lever moves said firing pin rearward.

8. The improvement of claim 7 and further comprising:

a firing spring urging said firing pin in a forward cartridge-firing direction;

a breech block spring urging the breech block in said forward direction, the springs being sized and supported to apply greater forwardly directed force on the breech block than on the firing pin, whereby the firing pin is retracted when the breech block moves the cocking lever.

9. The improvement of claim 7 wherein:

said firing pin is elongate and of generally cylindrical cross section and has a transverse aperture therein;

a rear pin is received in said aperture and is movable therein transversely of said firing pin;

a sear spring is received in said aperture and seats in said firing pin and urges said sear pin outwardly in said aperture, said sear pin being normally confined in said aperture by said spring and by an interior wall of said breech block.

10. The improvement of claim 9 and further comprising:

a sear pin aperture in said breech block, said transverse aperture being movable into registry with said sear pin aperture during relative movement of said firing pin and said breech block to enable transverse movement of said sear pin to enter into said breech block to fix a relative cocked position of said firing pin in said breech block;

a sear release pin having one end abuttingly engageable with said sear pin;

the relationship of said cocking lever with said housing and said transverse aperture in said firing pin and said sear pin aperture in said breech block, being such as to prevent alignment of the said apertures except when said breech block has engaged and operated said cocking lever to retract said firing pin into said cocked position relative to said breech block.

11. The improvement of 10 wherein:

said housing includes a sear release pin aperture therein;

said breech block being movable rearward into a position of registry of said sear pin aperture with said sear release pin aperture for arming the gun.

12. The improvement of claim 11 and further comprising:

a trigger mounted to said housing;

an elongate sear drive lever having one end pinned to said housing and an opposite end pinned to said sear release pin, and having a slot therein extending between said ends, said trigger including a cam pin received in said slot and operable when said trigger is moved in a rearward direction by an external force, to drive said sear release pin against said sear pin and move said sear pin out of firing pin restraining position to enable the firing pin to advance from cocked position to cartridge-firing position.

13. The improvement of claim 12 and further comprising:

gun cocking rod means on said breech block and extending forward for engagement by said barrel when said barrel is moved to the rear to enable the barrel to push the breech block back to the position of enabling said sear release pin to engage the sear pin for firing the gun.

14. The improvement of claim 13 and further comprising:

safety head means at the front end of the barrel and having a lost motion mounting to the barrel, said lost motion mounting to the barrel including spring means thereon, said spring means and lost motion mounting being insufficient to apply a twenty pounds force rearward on the barrel to push the breech block back to said position of enabling the sear release pin to engage the sear pin for firing the gun.

15. The improvement of claim 14 wherein the lost motion means include:

a safety head slidably mounted to the front of the barrel; and a safety spring mounted between a front facing shoulder of the barrel and a rear facing shoulder of the head and urging th head forward in the barrel.

16. The improvement of claim 6 and wherein: said cam pin on the trigger and said slot in the drive lever are so related as to enable forward movement of the trigger to positively pull the shear release pin out of the sear pin aperture in the breech block to free the breech block from impediment by the sear release pin to linear movement in the housing.

* * * * *

UNITED STATES PATENT AND TRADEMARK OFFICE

CERTIFICATE OF CORRECTION

PATENT NO. : 4,804,127

DATED : February 14, 1989

INVENTOR(S) : John W. Kirkman

It is certified that error appears in the above-identified patent and that said Letters Patent is hereby corrected as shown below:

In the Abstract, line 1, change "breach" to --breech--.

Column 8, line 22, change "rear" to --sear--.

Column 10, line 9, change "th" to --the--.

Signed and Sealed this

Fifteenth Day of August, 1989

*Attest:*

DONALD J. QUIGG

*Attesting Officer*

*Commissioner of Patents and Trademarks*